US005652977A

United States Patent [19]

Vayda

[11] Patent Number: 5,652,977

[45] Date of Patent: Aug. 5, 1997

[54] SETTLE BED CONSTRUCTION

[76] Inventor: George T. Vayda, 405 Church St., Hertford, N.C. 27944

[21] Appl. No.: 661,204

[22] Filed: Jun. 10, 1996

[51] Int. Cl.[6] ..... A47C 17/16; A47C 17/22

[52] U.S. Cl. ..... 5/43; 5/58; 5/134

[58] Field of Search ..... 5/134, 58, 12.1, 5/43; 297/2

[56] References Cited

U.S. PATENT DOCUMENTS

| | | | |
|---|---|---|---|
| 253,576 | 2/1882 | Bicknell . | |
| 464,387 | 12/1891 | Peace . | |
| 890,859 | 6/1908 | Harris | 5/134 |
| 973,108 | 10/1910 | Frye | 5/43 |
| 1,337,580 | 4/1920 | Ball . | |
| 1,464,605 | 8/1923 | Haugland . | |
| 2,115,646 | 4/1938 | Plew | 5/134 |
| 2,414,998 | 1/1947 | Barnum | 5/134 |

FOREIGN PATENT DOCUMENTS

| | | | |
|---|---|---|---|
| 208921 | 3/1940 | Switzerland | 5/43 |
| 265466 | 12/1949 | Switzerland | 5/43 |

*Primary Examiner*—Alexander Grosz
*Attorney, Agent, or Firm*—Henderson & Sturm

[57] ABSTRACT

A settle bed construction (10) comprising a framework unit (11) having a pair of rocker panels (25)(26) formed on each end, and each rocker panel (25)(26) is provided with an arcuate rocker panel element (28); and each of the rocker panels (25)(26) are provided with an inner (31) and an outer (30) support panel pivotally connected to the respective rocker panels (25)(26); such that the construction (10) may be employed as a bench seat or as a bed.

10 Claims, 4 Drawing Sheets

SETTLE BED CONSTRUCTION

TECHNICAL FIELD

The present invention relates to the field of convertible beds in general, and in particular to a settle bed construction having a unique support structure.

BACKGROUND ART

As can be seen by reference to the following U.S. Pat. Nos. 253,576; 464,387; 1,464,605; and 2,414,998; the prior art is replete with myriad and diverse convertible bed constructions.

While all of the aforementioned prior art constructions are more than adequate for the basic purpose and function for which they have been specifically designed, they are also uniformly deficient with regard to the stability of their associated support structure as well as their usefulness in adequately performing both roles that they were designed to fulfill.

While the obvious role of a convertible bed construction is to function not only as a bed but also as another piece of furniture to minimize space requirements for the user, it seems that the prior art constructions will sacrifice either stability, comfort, or full fledged dual function to accomplish their basic goal.

As a consequence of the foregoing situation, there has existed a longstanding need among individuals who are contemplating purchasing a convertible bed that they receive full value and function for their expenditure of funds; and, the provision of such a construction is a stated objective of the present invention.

DISCLOSURE OF THE INVENTION

Briefly stated, the settle bed construction that forms the basis of the present invention comprises in general a bed framework unit and a primary support unit. The bed framework unit also includes a pair of rocker panel members having arcuate rocker panel elements on opposite ends of the settle bed construction that allow the construction to be quickly pivoted from one mode of operation to the other mode of operation.

As will be explained in greater detail further on in the specification, the primary support unit includes two pairs of pivoted support panels that are operatively associated with one another and the bed framework unit to provide stability and support to the settle bed construction in both modes of operation.

In addition, the settle bed construction of this invention also incorporates a hidden storage compartment and a hidden auxiliary support unit into its basic design; as well as providing other novel features that are not readily apparent at first glance, yet which serve both beneficial purposes for the user and facilitate the cooperation and/or interaction of the various structural components employed.

BRIEF DESCRIPTION OF THE DRAWINGS

These and other attributes of the invention will become more clear upon a thorough study of the following description of the best mode for carrying out the invention, particularly when reviewed in conjunction with the drawings; wherein.

BEST MODE FOR CARRYING OUT THE INVENTION

Figure 1:
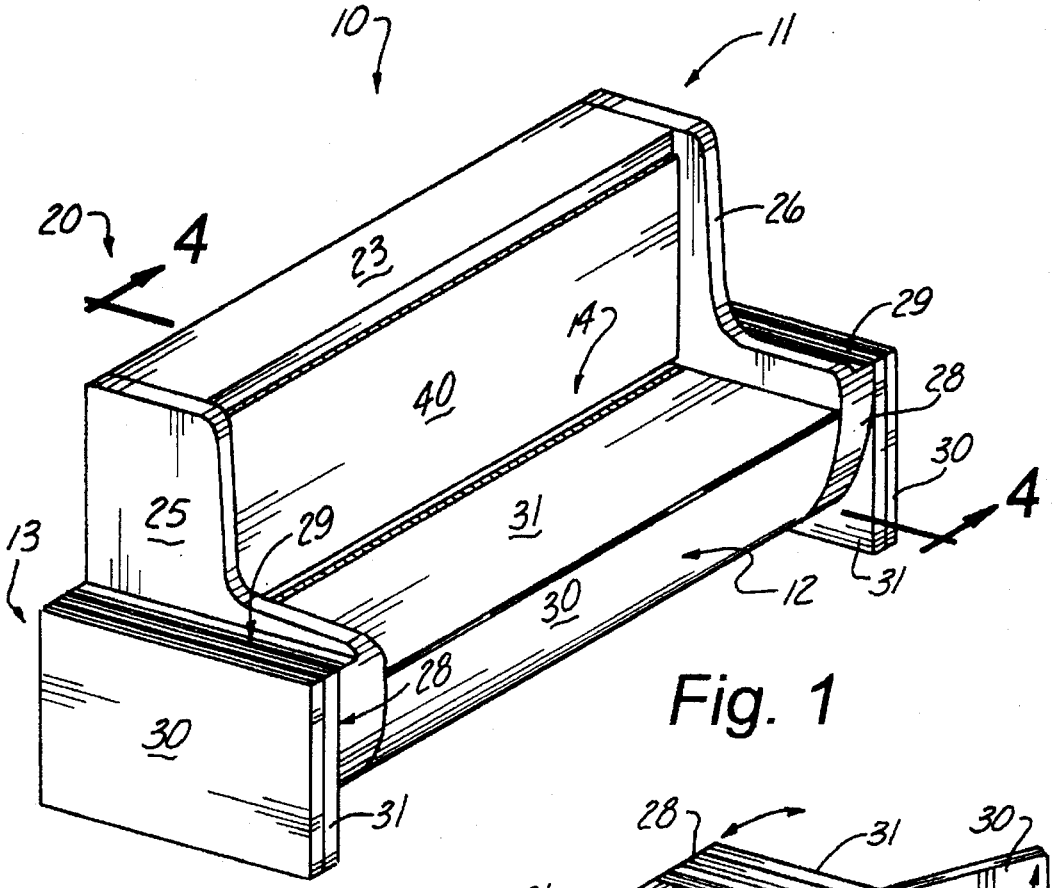
FIG. 1 is a perspective view of one version of the settle bed construction that forms the basis of the present invention deployed in the storage mode.

As can be seen by reference to the drawings, and in particular to FIG. 1, the settle bed construction that forms the basis of the present invention is designated generally by the reference numeral (10). The construction (10) comprises in general a bed framework unit (11) a storage unit (12) a primary hinged support unit (13) and an optional auxiliary hinged support unit (14). These units will now be described in seriatim fashion.

Figure 2:
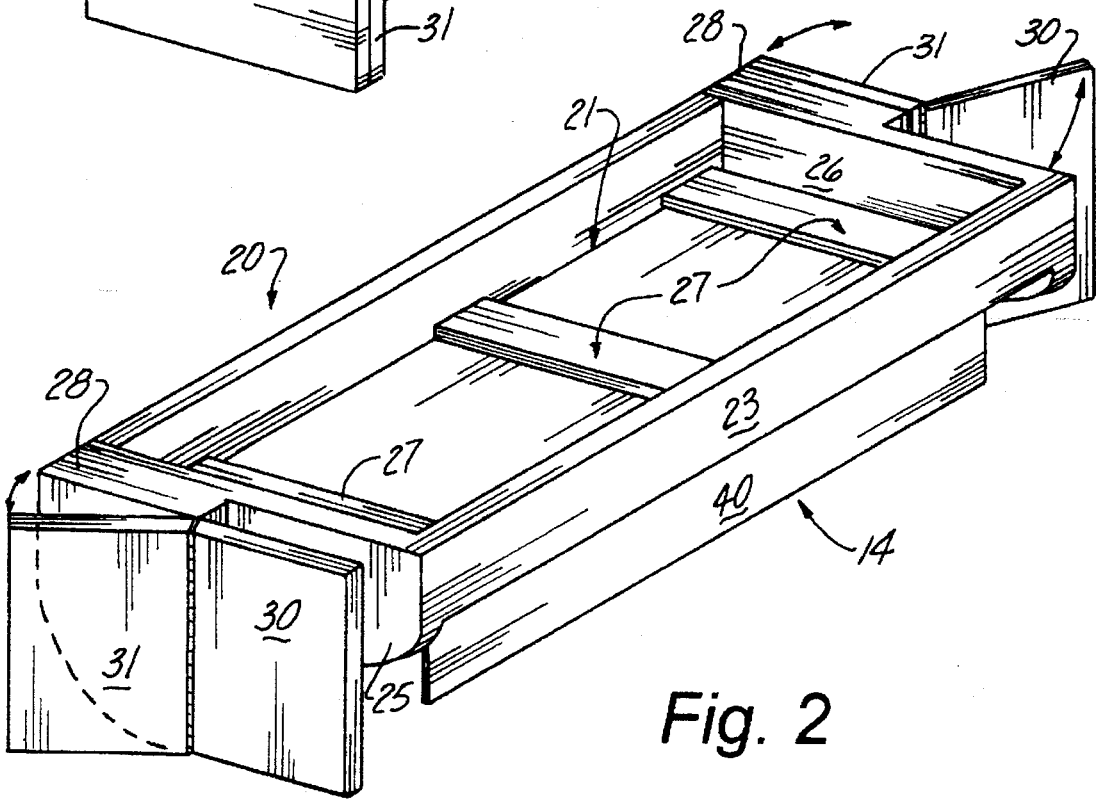
FIG. 2 is a perspective view of the version of FIG. 1 deployed in its operative mode.
Figure 3:
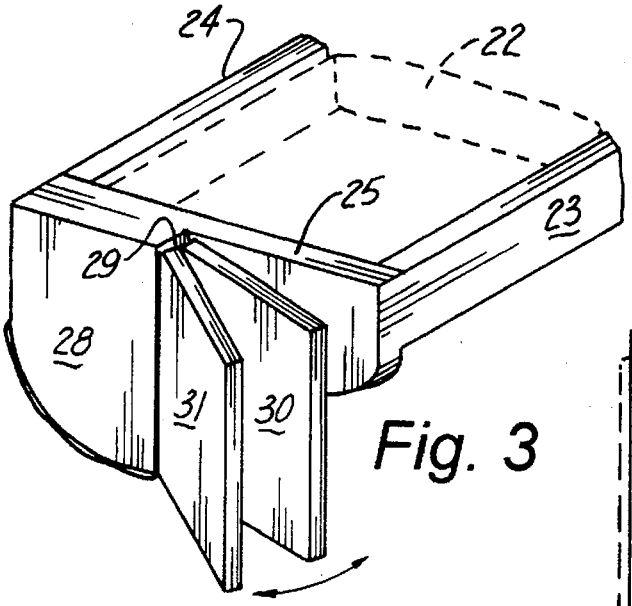
FIG. 3 is an isolated detail view of the cooperation of the hinged panel members with the rocker panels.

As can best be seen by reference to FIGS. 1 and 2, the bed framework unit (11) comprises a framework member (20) including a generally elongated rectangular mattress compartment (21) dimensioned to receive a mattress (22) depicted in phantom in FIG. 3. In addition, the framework member (20) comprises a pair of elongated rectangular side panels (23) (24), a pair of enlarged contoured rocker panels (25) and (26) disposed on the opposite ends of the framework member (20) and a plurality of mattress support slats (27) extending between the side panels (23) and (24).

Furthermore, each of the contoured panels (25) and (26) are provided with an enlarged arcuate rocker panel element (28) which projects outwardly from the side of the rocker panels (25)(26), and forms a shelf(29) thereon; wherein, the purpose and function of the shelf (29) will be explained further on in the specification.

Figure 4:
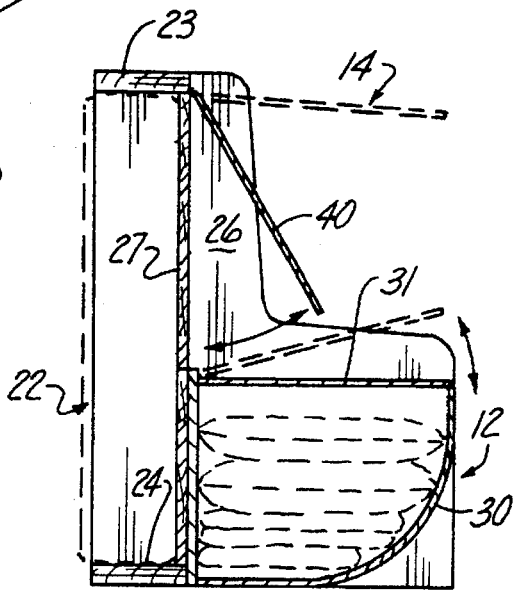
FIG. 4 is a cross-sectional view taken through line 4—4 of FIG. 1.

Turning now to FIGS. 1 and 4, it can be seen that the storage unit (12) includes a generally arcuate storage compartment (30) extending between the rocker panels (25) and (26); wherein, the storage compartment (30) is further provided with a hinged closure (31) which also serves as a bench seat when the settle bed construction is deployed as depicted in FIGS. 1 and 4.

As can best be appreciated by reference to FIGS. 1 through 3 and 5 through 7, the primary hinged support unit (13) comprises in general two pairs of hinged members (30) and (31) wherein each pair of hinged support members (30)

(31) are operatively associated with one of the contoured rocker panels (25) (26) and comprise an outer support panel (30) and an inner support panel (31).

In the alternate version of the preferred embodiment depicted in FIGS. 1 through 3 and 5 through 7, the inner (31) and outer (30) support panels are operatively connected to one another and the respective rocker panel elements (28) by a double hinge plate member (33) having a pair of hinge pins (34) and (35). This arrangement allows the outer support panel (30) to be pivoted relative to the inner support panel (31) as shown in phantom in FIG. 6, and the outer (30) and inner (31) support panels to be pivoted as a unit relative to the shelf(29) of the rocker panel element (28) as depicted in phantom in FIG. 5 for reasons that will be explained presently.

The basic operation of the settle bed construction (10) depicted in FIGS. 1 through 7 proceeds according to the following steps. When it is desired to change the orientation of the settle bed construction from the storage mode of FIG. 1 to the bed mode of FIG. 2, the inner and outer support panels (31) (30) on both ends of the framework member (20) are pivoted into the position depicted in phantom in FIG. 5, so that the support panels (30) (31) are resting on top of the shelf(29) on each rocker panel element (28) thereby exposing the arcuate configuration of the rocker panel elements (28). At this juncture, a slight forward tipping of the framework member (20) will pivot the framework member (20) in a clockwise direction such that mattress compartment (21) is disposed in the horizontal orientation depicted in FIG. 3.

Figure 5:
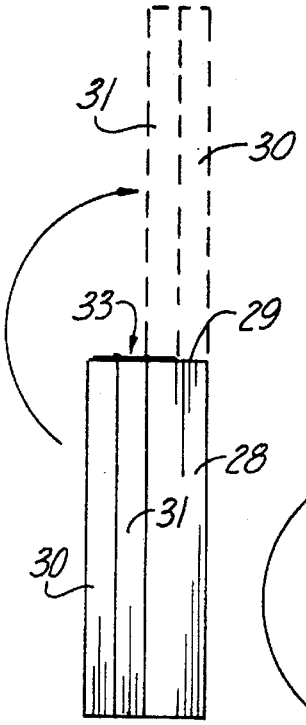
FIG. 5 is an isolated end view showing one orientation of the hinged panel members relative to the rocker panel member.
Figure 6:
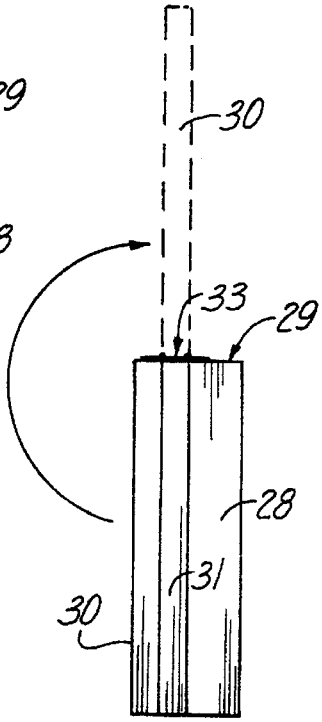
FIG. 6 is an isolated end view showing another orientation of the hinged panel members relative to the rocker panel member.
Figure 7:
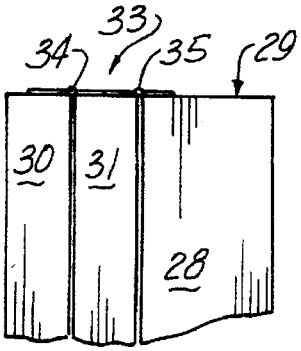
FIG. 7 is an isolated detail view of the double hinge arrangement that operatively engages the hinged panel members to the rocker panel member.

Once the construction is deployed in the orientation of FIG. 3, the hinged support panels (30) (31) are pivoted as a unit to solid line position of FIG. 5, whereupon the outer support panel (30) is pivoted to the dashed line position of FIG. 6 to complete the conversion to the bed mode of the apparatus.

By this juncture, it should be apparent that the double hinged support panel arrangement (30) (31) is necessary for a variety of reasons. To begin with, the plural support panels provide an increased width support surface on opposite ends of the construction (10) when it is in its storage or non-bed mode of disposition. In addition, the tops of the support panels (30)(31) increases the effective width of the shelves (29) on either end of the construction (10), so that the shelves (29) and support panels (30)(31) may serve as arm rests or mini-end tables for the seat bunch mode of disposition.

Furthermore, both of the hinged support panels (30)(31) must be pivoted away from the rocker panel elements (28) to expose their arcuate periphery and allow the apparatus to be converted from one mode of disposition to the other. Obviously, when the apparatus (10) is to be employed as a bed, further manipulation of the support panels (30) and (31) are required to both cancel out the inherent instability of the rocker panel elements (28) by placing the inner support panels (31) adjacent thereto; and to provide stability along the length of both ends of the construction (10) by pivoting the outer support panel perpendicular to and in the direction of the front side (23) of the bed.

As was mentioned previously this version of the construction (10) also contemplates an optional auxiliary hinged support unit (14) which is shown in FIGS. 1, 2 and 4; wherein, the auxiliary support unit (14) comprises an enlarged rectangular panel (40) pivotally secured on one end to the framework member (20) and dimensioned to form a backrest when the construction (10) is deployed in the bench seat mode of FIG. 1; yet having a sufficient length to also function as a generally thin elongated front support leg for the apparatus when the construction is deployed in the bed mode of FIG. 2.

In the preferred embodiment of the invention illustrated in FIGS. 8 through 11, each of the outer support panels (30) are hingedly connected to the shelf (29) of the rocker panel elements (28); whereas, the inner support members (31) are substantially smaller in size than the outer support panels (30) disposed in recesses (35) in the rocker panel elements (28) and hingedly connected to the framework member (20) as will be explained presently.

The primary differences between the hinged panel arrangements of the preferred embodiment and the first version of the apparatus described herein are that the inner (31) and outer (30) support panels of the preferred embodiment are not directly connected to one another, have different sizes and the hinged connections of the inner and outer support panels (31) and (30) are disposed perpendicular to one another.

Figure 8:
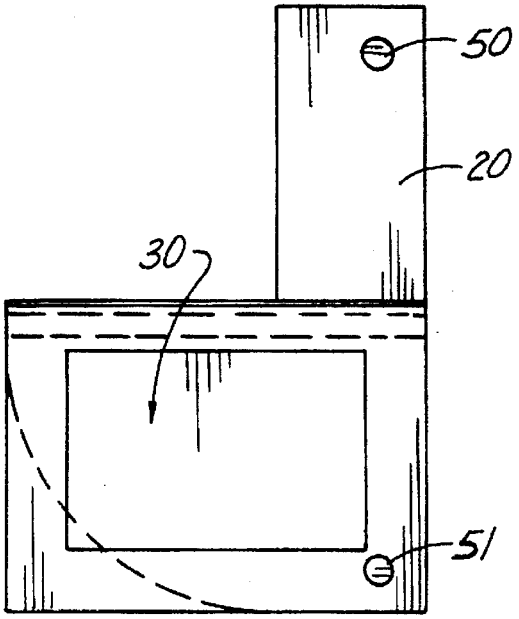
FIG. 8 is an end view of the preferred embodiment of the invention in the storage position.

As can best be seen by sequential reference to FIGS. 8 through 12 in the preferred embodiment of the invention, both of the inner (31) and outer (30) support panels support the opposite ends of the construction (10) while in the bench seat mode depicted in FIG. 8.

Figure 9:
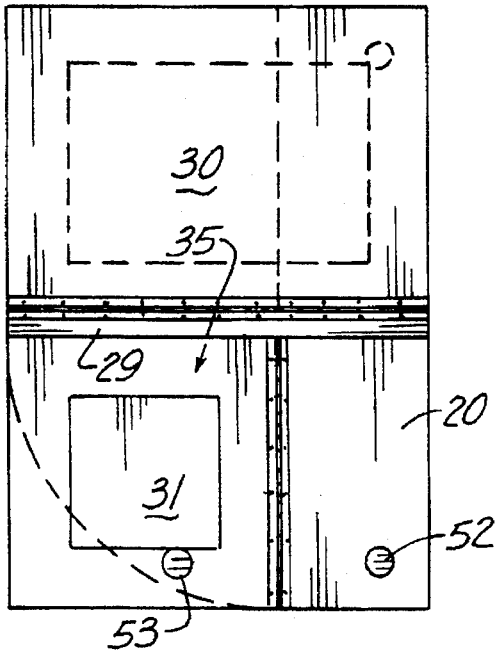
FIG. 9 is an end view of the embodiment of FIG. 8 with the outer panel deployed in the extended mode.
Figure 10:
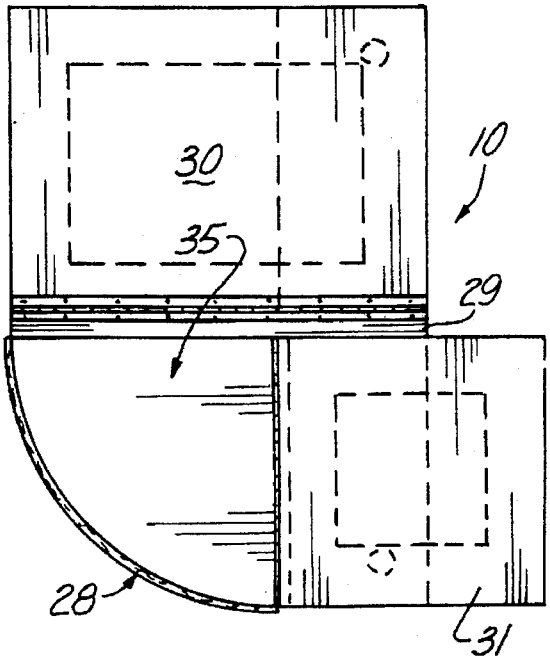
FIG. 10 is an end view of the preferred embodiment with the inner panel extended to uncover the rocker panel into the operative mode.

Then, when it is desired to convert the use of the construction (10) into a bed mode, the first step requires the pivoting of the outer support panel (30) upwardly as shown in FIG. 9, thereby exposing the inner support panel (31) which is still retained within the recess (35).

Still referring to FIGS. 8 and 9, it can be seen that the preferred embodiment of the invention contemplates the use of magnetic elements (50) and (52) on the framework member (20) as well as magnetically attractive elements (51) and (53) on the outer (30) and inner (31) support panels respectively to temporarily immobilize the support panels (30) (31) relative to the framework member (20).

Figure 11:
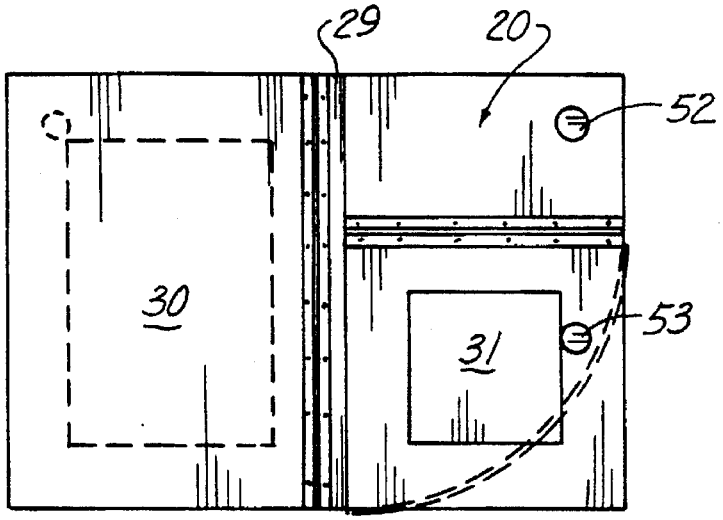
FIG. 11 is an end view of the preferred embodiment rotated into the bed position.
Figure 12:
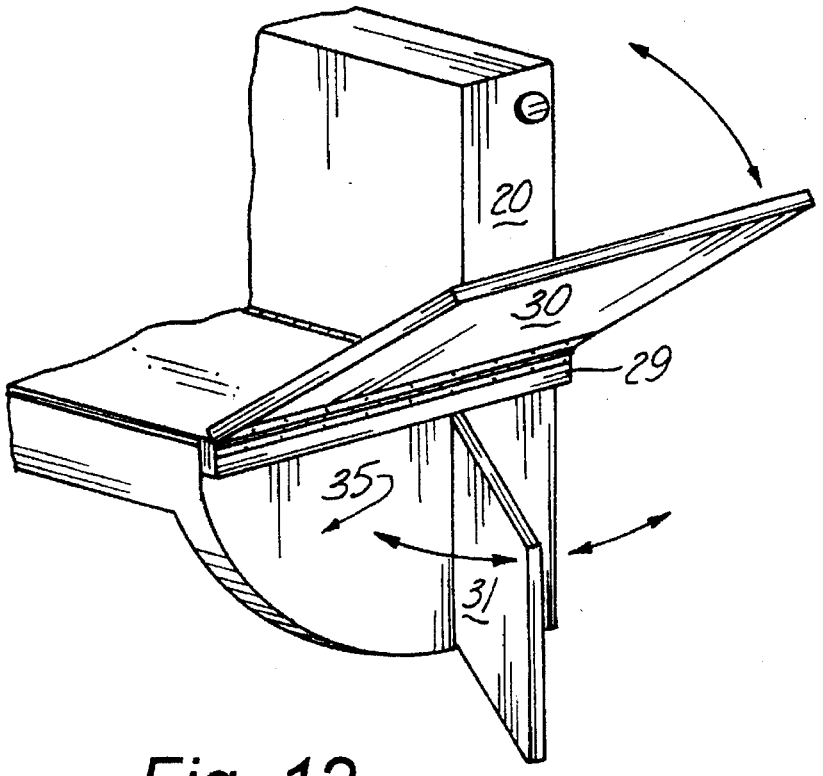
FIG. 12 is an isolated detail view of the hinged support panels.

Once the outer support panel (30) exposes the inner support panel (31) the inner support panel (31) is pivoted outwardly to expose the rocker panel element (28). The construction (10) is then tipped in a clockwise direction as viewed in FIG. 10 to orient the construction (10) as shown in FIG. 11; whereupon the inner support panel (31) is once more returned to the recess (35) in the rocker panel element (28) to immobilize the rocker panel element (28) against further movement.

Having thereby described the subject matter of the present invention, it should be apparent that many substitutions, modifications and variations of the invention are possible in light of the above teachings. It is therefore to be understood that the invention as taught and described herein is only to be limited to the extent of the breadth and scope of the appended claims.

I claim:

1. A settle bed construction that may be employed in a bench seat mode or a bed mode wherein the construction comprises a framework unit having opposed sides and ends defining a mattress receiving compartment, wherein the opposite ends of the framework unit comprise enlarged contoured rocker panels wherein each rocker panel is provided with an arcuate rocker panel element; and a primary support unit operatively associated with the framework unit wherein the primary support unit comprises two pairs of support panels and each pair of support panels is associated with one of the ends of the framework unit and includes an outer support panel and in inner support panel pivotally secured relative to each of the respective rocker panels.

2. The settle bed construction as in claim 1; wherein, the inner and outer support panels are pivotally secured to one another.

3. The settle bed construction as in claim 2; wherein the rocker panel element projects outwardly from the rocker panel to form a shelf which serves as a support surface for the inner and outer support panels.

4. The settle bed construction as in claim 2; wherein said inner and outer support panels are pivotally secured to one another and to one of the rocker panel elements by a double hinge plate member.

5. The settle bed construction as in claim 1; wherein the inner and outer support panels are pivotally secured in a generally perpendicular fashion relative to one another at spaced locations on each of the rocker panels.

6. The settle bed construction as in claim 5; wherein said outer support panel is substantially larger than and overlies said inner support panel.

7. The settle bed construction as in claim 6; wherein each rocker panel element is provided with a recess dimensioned to receive one of the inner support panels.

8. The settle bed construction as in claim 1; wherein each of the contoured rocker panels is provided with means for captively engaging the inner and outer support panels.

9. The settle bed construction as in claim 1; wherein, said framework unit is further provided with a storage compartment having a hinged lid; wherein, the storage compartment extends between the contoured rocker panels.

10. The settle bed construction as in claim 1; further including an auxiliary support unit including an elongated support panel pivotally secured relative to one of the sides of the framework unit.

* * * * *